United States Patent [19]

Smith

[11] 4,375,017

[45] Feb. 22, 1983

[54] CALCULATOR TYPE KEYBOARD INCLUDING PRINTED CIRCUIT BOARD CONTACTS AND METHOD OF FORMING

[75] Inventor: Theodore D. Smith, Indianapolis, Ind.

[73] Assignee: RCA Corporation, New York, N.Y.

[21] Appl. No.: 134,214

[22] Filed: Mar. 26, 1980

Related U.S. Application Data

[63] Continuation of Ser. No. 748,026, Dec. 6, 1976, abandoned.

[51] Int. Cl.[3] ..... H01H 13/70; H01H 1/00; H01H 11/04

[52] U.S. Cl. ..... 200/5 A; 29/622; 200/159 B; 200/275; 200/292

[58] Field of Search ..... 200/5 R, 5 A, 159 A, 200/159 B, 275, 279, 292; 29/622, 829, 846, 847

[56] References Cited

U.S. PATENT DOCUMENTS

| | | | |
|---|---|---|---|
| 2,722,584 | 11/1955 | Skag | 200/279 X |
| 3,024,334 | 3/1962 | Rhodes | 200/292 X |
| 3,714,384 | 1/1973 | Burkhardt et al. | 200/279 X |
| 3,749,859 | 7/1973 | Webb et al. | 200/275 X |
| 3,806,673 | 4/1974 | Boulanges | 200/159 B X |
| 3,886,341 | 5/1975 | Forrest | 200/159 B X |
| 3,922,814 | 12/1975 | Runft | 200/279 X |
| 3,967,084 | 6/1976 | Pounds | 200/292 X |
| 3,973,091 | 8/1976 | Kaminski | 200/159 B X |
| 3,996,429 | 12/1976 | Chu et al. | 200/5 A |
| 4,046,981 | 9/1977 | Johnson et al. | 200/159 B |

FOREIGN PATENT DOCUMENTS

| | | | |
|---|---|---|---|
| 894127 | 10/1953 | Fed. Rep. of Germany | 200/279 |

*Primary Examiner*—James R. Scott
*Attorney, Agent, or Firm*—E. M. Whitacre; P. J. Rasmussen; P. M. Emanuel

[57] ABSTRACT

A switch mechanism useful in a calculator type keyboard includes a printed circuit board conductor in which is punched a crater-like depression with a raised edge portion and a dome-like member positioned so that its apex may contact the raised edge portion when the switch mechanism is depressed. The punched crater-like depression is specifically formed by striking the printed circuit board conductor to form an edge extending above the predetermined height of the conductor surface, which in turn, is disposed above the planar surface of the dielectric substrate.

10 Claims, 6 Drawing Figures

CALCULATOR TYPE KEYBOARD INCLUDING PRINTED CIRCUIT BOARD CONTACTS AND METHOD OF FORMING

This is a continuation of application Ser. No. 748,026 filed Dec. 6, 1976, now abandoned.

BACKGROUND OF THE INVENTION

The present invention is directed to the field of electrical contacts for switch mechanisms.

Switch mechanisms which may, for example, be employed in a calculator type keyboard typically consist of a conductive spring material spaced from conductors mounted on a dielectric substrate such as a printed circuit board. When the spring member is urged against the conductors, contact closure is made and the switch is closed. Some switch mechanisms include provisions by which contact elements are wiped against each other as closure takes place so as to produce a contact cleaning action to maintain electrical characteristics of the switch mechanism over a relatively large number of operations. However, where a switch mechanism includes contact elements which cannot be caused to wipe against each other, other provisions for maintaining the electrical characteristics of the switch mechanism should desirably be provided.

Where the contact elements comprise flat surfaces which contact each other without a wiping action, it may be necessary to coat their surfaces with a precious metal such as gold or silver. This is costly. Furthermore, even with such a coating, should foreign matter become lodged between the surfaces of the two contact elements, no contact closure will occur because there is no wiping action available to dislodge the foreign matter.

So that foreign matter cannot readily be lodged between two contact surfaces, one of the contact surfaces may be provided with a raised portion. A switch mechanism including a contact with a raised portion is described, for example in U.S. Pat. No. 3,886,341. However, because of the manner in which these raised portions are formed, e.g., by bending or otherwise deforming a separate piece of metal, they cannot be readily employed with contacts which comprise conductors of a printed circuit board.

SUMMARY OF THE INVENTION

A switch mechanism constructed in accordance with the present invention includes a printed circuit board conductor having a crater-like depression with a raised edge portion and a conductor member positioned to contact the raised edge portion.

DETAILED DESCRIPTION OF THE PREFERRED EMBODIMENT

Figure 1:
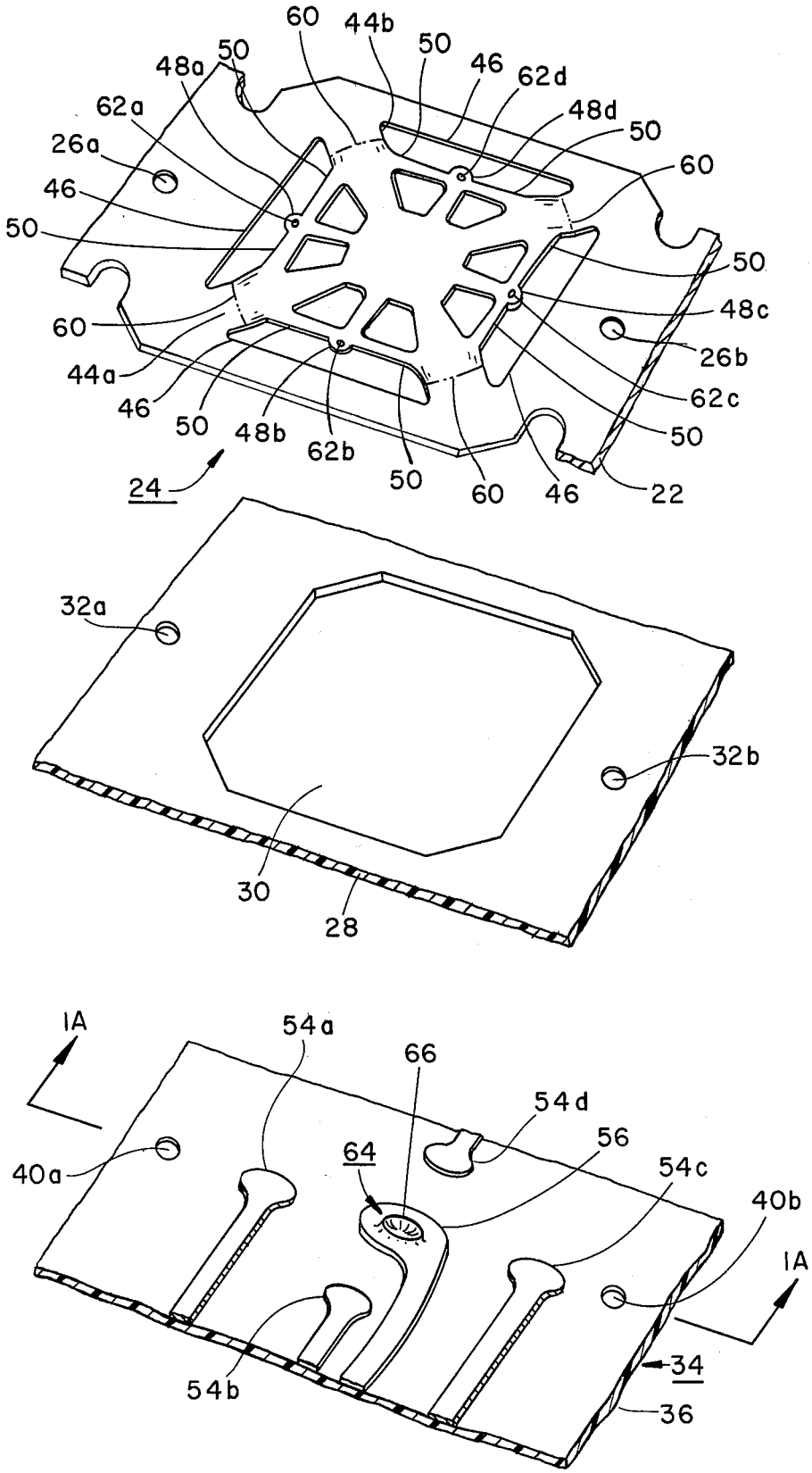
FIG. 1 is an exploded view of a switch mechanism employing a contact constructed in accordance with the present invention.

In FIG. 1, a switch mechanism 24 which may be utilized in a calculator type keyboard is formed as an integral part of a conductive web 22. Although only switch mechanism 24 is shown, it will be appreciated that web 22 may be partitioned in an array of switch mechanisms positioned in accordance with push buttons, also not shown, of the keyboard. Switch mechanism 24 includes support arms 44*a* and 44*b* which extend diagonally across a square cutout portion of web 22 and intersect in a crisscross configuration. The intersection of supports arms 44*a* and 44*b* is in axial alignment with a respective push button. A portion of the crisscross configuration inward of the periphery 46 of fthe cutout portion, the extent of which is defined by a border 60, is contoured to form a dome-like shape. Contact blades 48*a*, 48*b*, 48*c* and 48*d* extend radially outward from the intersection of support arms 44*a* and 44*b* between adjacent portions thereof. The outer ends of contact blades 48*a*, 48*b*, 48*c* and 48*D* are connected by bridge members 50 to adjacent portions of support arms 44*a* and 44*b*. The tips of contact blades 48*a*, 48*b*, 48*c* and 48*d* extend slightly beyond bridge members 50 and have contact points or indentations 62*a*, 62*b*, 62*c* and 62*d* directed downward formed therein.

Beneath web 22 there is located a nonconductive spacer 28 having an aperture 30 in general alignment with switch mechanisms 24*a*, 24*b* and 24*c*. Beneath spacer 28 there is located a printed circuit board 34 comprising a dielectric material 36 having a surface on which there are formed conductors ending in contact pads 54*a*, 54*b*, 54*c* and 54*d* in alignment with contact points 62*a*, 62*b* , 62*c* and 62*d* of contact blades 48*a*, 48*b*, 48*c* and 48*d* of switch mechanism 24 and a center contact pad 56 in alignment with the apex of the dome-like shape of switch mechanism 24.

The printed conductors may be formed in a variety of well-known ways. For example, the printed conductors may be formed by chemically removing conductor material from a conductor (e.g., copper) clad dielectric board in predetermined areas where the conductor material is not protected by a solvent resistant coating previously printed on the board in accordance with a mask. The printed conductors may also be made by an additive process whereby conductor material (e.g., copper) is chemically or electrochemically deposited on an unclad dielectric board in predetermined areas previously printed on the board in accordance with a mask.

A crater-like depression 64 with a raised rim 66 is formed in center conductor pad 56 by striking conductor pad 56 with a generally spherical head. As is seen in the cross-sectional view of FIG. 1*a*, taken in the direction of section lines 1A—1A of FIG. 1, the punch is struck with sufficient force so that as the conductor and dielectric material at the center of the crater 64 is forced downward, surrounding conductor and dielectric material is displaced upward to form rim 66 having a relatively sharp edge above the surface of conductor 56.

Although body portion of the calculator type keyboard includes walls and support structure such as guide pins positioned to be received by guide holes 26*a*, 26*b*, 32*a*, 32*b*, 40*a* and 40*b* of web 22, spacer 28, and printed circuit board 34, respectively, to hold web 22, spacer 28 and printed circuit board 34 in abutting relationship, these members have been omitted to more clearly show the contact structure of the switch mechanism. A more detailed description of a calculator type keyboard switch mechanism similar to the one shown in FIG. 1 is provided in copending U.S. patent application Ser. No. 748,025 issued on Apr. 11, 1978, as U.S. Pat. No. 4,084,071 entitled, "Switch Mechanism for a Calculator Type Keyboard", concurrently filed in the name of the same inventor as the present invention, hereby incorporated by reference. FIGS. *2a–2c, 3a–3c* and *4a–4c* of the referenced U.S. patent indicate the manner in which sequential switching occurs when switch member 24 is depressed in the manner set forth below.

In operation, when switch mechanism 24 is depressed by means of an associated push button, support arms 44*a* and 44*b* bend downward at periphery 46 and bridge members 50 urge contact points 62*a–*62*d* of contact blades 48*a–*48*d* into contact with conductor pads 54*a–*54*d*, respectively, essentially at the same time. The closures of contact points 62*a–*62*d* and conductor pads 54*a–*54*d* are used to generate binary code signals representing the function or decimal digit associated with the particular push button being depressed. For example, assuming that conductor pad 54*d* is coupled to +5 VDC, the conductor arrangement of FIG. 1 will provide the binary coded decimal (BCD) word, i.e., 111, corresponding to the decimal digit 7 because +5 VDC, i.e., a logic 1, will be coupled to each of the remaining conductor pads 54*a–*54*c* when switch mechanism 24 is depressed.

As switch mechanism 24 is further depressed, the dome-like shape deflects in an "oil can" manner and there is a sudden release of pressure providing a tactile indication to an operator of the operation of the switch mechanism. When switch mechanism 24 is fully depressed, the apex of the dome-like shape contacts rim 66 of center conductor pad 56. The closure of the apex and center conductor pad 56 is used to generate a flag signal to indicate that all the data contacts have been closed and that the data may now be reliably utilized.

Between the time contact points 62*a–*62*d* make contact with conductor pads 54*a–*54*d* and the time the apex of the dome-like shape makes contact with rim 66, contact points 62*a–*62*d* slide radially across the surface of contact pads 54*a–*54*d* thereby cleaning their respective surfaces. Unfortunately, because the apex of the dome-like shape moves only in the axial direction with respect to conductor pad 56, there is no wiping action available to clean their respective contact areas. Nevertheless, the contact areas of the apex of the dome-like shape and conductor pad 56 remain relatively clean because foreign matter such as a dirt particle cannot readily be supported by the relatively sharp edge of rim 66. Furthermore, with a given amount of pressure, the relatively sharp edge of rim 66 provides a relatively low contact resistance in comparison with the broader areas of flat or smoothly curved contact surfaces conventionally employed because of the relatively greater unit pressure, i.e., pressure per unit of area, associated with rim 66. In addition to the performance advantages of crater-like contact 64, it is noted that it is simply and economically formed, in the manner set forth above without having to deform and then mount a separate conductor.

Figure 1A:
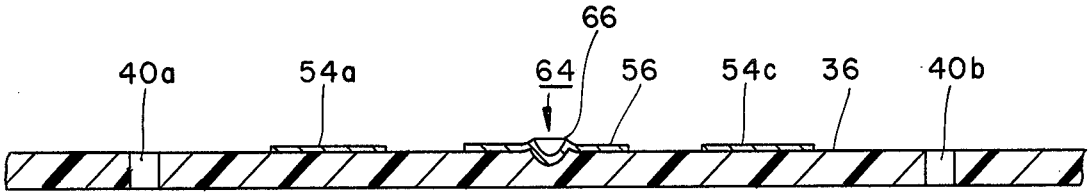
FIG. 1*a* is a cross-sectional view taken in the direction of section lines 1A—1A of FIG. 1 showing in more detailed fashion the contact structure of FIG. 1.
Figure 2A:
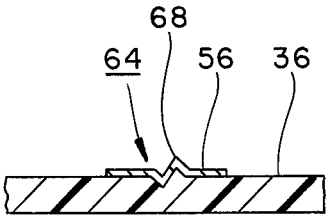
FIG. 2*a* is a cross-sectional view taken in the direction of section lines 2A—2A of FIG. 2.
Figure 2:
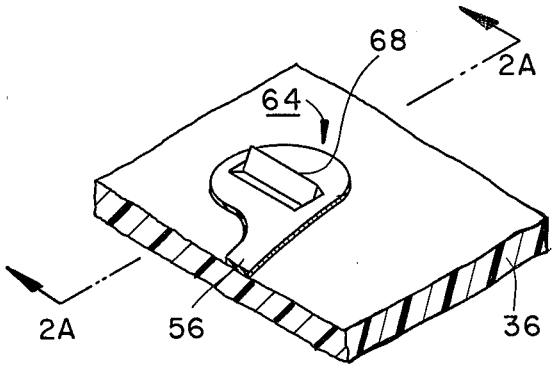
FIG. 2 is an isometric view of another contact structure formed in accordance with the present invention.
Figure 3A:
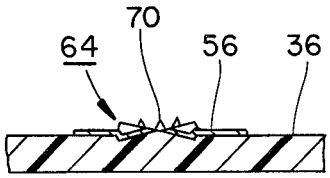
FIG. 3*a* is a cross-sectional view taken in the direction of section lines 3A—3A of FIG. 3.
Figure 3:
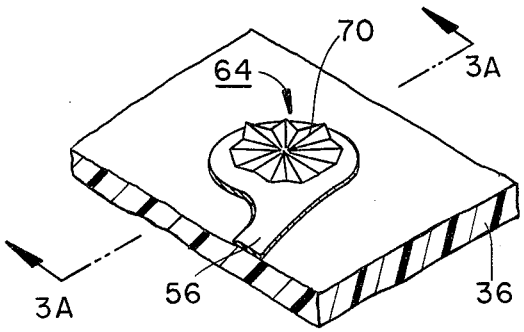
FIG. 3 is an isometric view of still another contact structure formed in accordance with the present invention.

In FIGS. 2 and 3 there are shown other contact structures having crater-like portions with the performance and manufacturing advantages set forth with respect to crater-like contact 64 of FIGS. 1 and 1*a*. In FIG. 2 and FIG. 2*a*, which is a cross-sectional view taken in the direction of section lines 2A–2A of FIG. 2, there is shown a crater-like contact structure 64 formed by striking conductor pad 56 with a punch having a chisel type head with sufficient force so that as a depression below the surface of conductor pad 56 is produced, conductor and dielectric material is upwardly displaced to produce knife-like edge 68 above the surface of conductor pad 56. By altering the force and the shape of the chisel head of the punch, two knife-like contact edges may be produced. In FIGS. 3 and 3*a*, there is shown a star-like contact structure having a plurality of radially disposed crater-like depressions each of which has a raised knife-like contact edge 70. This contact structure may be formed by striking conductor pad 56 with a punch having a plurality of radially disposed chisel members at its head.

What is claimed is:

1. Apparatus comprising:

a printed circuit board including a dielectric substrate and a conductive layer formed on the surface of the dielectric substrate;

an impact crater formed in said conductive layer at an imperforate portion of said dielectric substrate having an abrupt raised edge integral with the material of said conductive layer and extending outward from the surface of said conductive layer;

a movable member positioned over said raised edge of said impact crater; and means for urging said movable member into contact with said edge of said impact crater.

2. The apparatus recited in claim 1 wherein said edge is a generally circular rim.

3. The apparatus recited in claim 1 wherein said edge has a generally straight portion.

4. The apparatus recited in claim 3 wherein a plurality of straight edges are radially disposed to form a star-like pattern.

5. The apparatus recited in claim 1 wherein said movable contact member includes a dome-like portion.

6. The apparatus recited in claim 5 wherein an area of said dome-like portion at least in proximity to the apex of said dome-like portion contacts said edge.

7. The apparatus recited in claim 1 wherein said printed circuit board includes at least a second conductor including a contact area positioned to be contacted by said movable contact member before said edge is contacted by said movable contact member.

8. The apparatus recited in claim 7 wherein said movable contact member includes support arms extending inward from the periphery of an aperture in a generally planar web to intersect in a crisscross configuration at least a portion of which is contoured in a dome-like shape, said dome-like shape having an apex in general alignment with said fixed contact member; and at least one contact blade extending outward from the intersection of said support arms, said contact blade contacting said contact area of said second conductor before an area of said dome-like shape at least in proximity to said apex contacts said edge of said fixed contact member.

9. A method for forming a fixed contact for a switch including a moveable contact, which when operated contacts said fixed contact, on a printed circuit board including a dielectric substrate having a substantially planar surface and a conductor formed on the planar surface of said dielectric substrate, the exposed surface of said conductor having a predetermined height above said planar surface of said dielectric substrate, comprising the step of:

striking the exposed surface of said conductor downward at an imperforate portion of said dielectric substrate with a punch with sufficient force so that as the conductor and dielectric material beneath the impact area are forced downward, surrounding conductor and dielectric material are abruptly displaced upward to form an edge of conductor material extending above said predetermined height of the exposed surface of said conductor above said planar surface of said dielectric substrate.

10. The method recited in claim 9 wherein:

said force is less than the force which would cause said dielectric substrate at said impact point to be pierced.

* * * * *